US005695222A

United States Patent [19]

Hodges

[11] Patent Number: 5,695,222

[45] Date of Patent: Dec. 9, 1997

[54] RATCHET TYPE CLOSET FLANGE

[75] Inventor: B. Eugene Hodges, Greenville, Mich.

[73] Assignee: James Bruno, Ada, Mich.

[21] Appl. No.: 594,593

[22] Filed: Jan. 31, 1996

[51] Int. Cl.[6] ..... F16L 35/00

[52] U.S. Cl. ..... 285/3; 285/15; 285/39; 285/56; 285/328; 285/346; 29/428

[58] Field of Search ..... 285/3, 4, 56, 57, 285/58, 59, 39, 162, 196, 338, 346, 323, 147, 148, 328, 15; 29/428

[56] References Cited

U.S. PATENT DOCUMENTS

| | | | |
|---|---|---|---|
| 402,600 | 5/1889 | Kemp | 285/338 X |
| 569,247 | 10/1896 | Smith . | |
| 1,529,607 | 3/1925 | Owen | 285/338 |
| 3,082,606 | 3/1963 | Calciano | 285/338 X |
| 3,192,614 | 7/1965 | Gardner, Sr. . | |
| 3,579,670 | 5/1971 | Frank . | |
| 3,703,302 | 11/1972 | Delmer, Sr. . | |
| 3,911,635 | 10/1975 | Traupe . | |
| 3,998,478 | 12/1976 | Zopfi . | |
| 4,059,289 | 11/1977 | Morris et al. . | |
| 4,092,745 | 6/1978 | Oropallo . | |
| 4,482,161 | 11/1984 | Izzi, Sr. . | |
| 4,497,511 | 2/1985 | Barker | 285/39 X |
| 4,505,499 | 3/1985 | Uglow et al. . | |
| 4,574,402 | 3/1986 | Brown, Sr. . | |
| 4,613,160 | 9/1986 | Reneau | 285/323 X |
| 4,773,678 | 9/1988 | Canaud et al. | 285/39 |
| 4,799,713 | 1/1989 | Uglow . | |
| 4,850,617 | 7/1989 | Moberlly . | |
| 4,922,951 | 5/1990 | Webster | 285/162 X |
| 4,984,308 | 1/1991 | Handal . | |
| 5,054,956 | 10/1991 | Huang . | |
| 5,090,737 | 2/1992 | Brammer et al. | 285/338 X |
| 5,141,633 | 8/1992 | Walczak et al. . | |
| 5,150,927 | 9/1992 | Skinner | 285/4 X |
| 5,190,320 | 3/1993 | Hodges . | |
| 5,209,522 | 5/1993 | Reaux | 285/147 X |
| 5,297,817 | 3/1994 | Hodges . | |
| 5,329,971 | 7/1994 | Condon . | |
| 5,335,945 | 8/1994 | Meyers . | |

*Primary Examiner*—Dave W. Arola
*Attorney, Agent, or Firm*—Robert W. Gustafson; Bullwinkel Partners, Ltd.

[57] ABSTRACT

A ratchet type closet flange for replacing broken cast iron closet flanges in old buildings or in new construction in place of conventional cast iron closet flanges. The patented invention comprising a flange body, a cup, a rubber seal, and a means for applying pressure. After removing the broken closet flange, the ratchet type closet flange is inserted into the existing pipe. A compression seal is formed between the flange body and the inside of the pipe by applying pressure to the flange body and the cup, forcing a compression seal between the rubber seal and the pipe. The ratchet type closet flange may slide up and down inside the pipe to achieve the desired height.

8 Claims, 3 Drawing Sheets

RATCHET TYPE CLOSET FLANGE

BACKGROUND

1. Field of the Invention

This patent relates to the plumbing trade. More particularly, this patent relates to a ratchet type closet flange which plumbers can use in old buildings to replace broken cast iron closet flanges. The present invention is also useful in new building construction in place of conventional cast iron closet flanges.

2. Description of the Related Art

Older homes and buildings typically contain cast iron drain pipes with leaded joints. In houses of two stories or more, the drain pipes usually run in the floor joist area, or the space between the floor of the higher floor and the plaster ceiling of the lower floor.

Plumbers typically seal joints between the pipes or between the pipe and a closet flange using the lead and oakum method. The lead and oakum method requires that the plumber use a chisel or similar implement to beat down oakum fiber into the joint, pour hot lead into the joint, and beat down the lead after it has cooled.

Broken closet flanges must be replaced. The traditional method of replacing broken closet flanges entails breaking the pipe at the joint between the pipe and replacing the flange. After breaking the pipe at the joint, the flange is cut off. Old lead is removed from the pipe and a new closet flange is installed, requiring a new joint seal.

There are several problems with the traditional method of replacing closet flanges. First, the pipe joint is often under the floor, making it difficult to replace the closet flange in the typical fashion. The plumber usually must tear up the floor to get to the joint because the hole that is in the flooring of older houses makes it very difficult to reach the joint. As previously noted, the plumber must break the joint before replacing the flange.

Second, the cost of replacing a closet flange in the typical fashion is very expensive and sometimes prohibitive. The plumber must remove the floor, break the joint, cut off the flange, clean out the lead from the joint, and install a new flange, reseal the joint, and rebuild the floor. Each of these steps is expensive. Reducing the process by any single step results in a substantial cost reduction.

Finally, the traditional method of replacing closet flanges is dangerous. Pouring hot lead into the new joint necessarily includes the risk of spilling hot lead onto the surrounding floor or other area. There is a risk of fire, a risk to any individuals in the area, and a risk of extensive damage to the flooring, whether made of tile, ceramic, wood, or other material Drain pipe installation of closet flanges in new buildings with concrete floors often involves additional or different problems. This type of building usually has the drain pipe installed first and the concrete floor poured later. The drain pipe usually extends above the level of the concrete floor. It is necessary to chip the concrete away from the drain pipe in order to install the new closet flange. This procedure is difficult, time consuming, and expensive.

One previous patent by the same inventor included many of the benefits of the present invention. Hodges' U.S. Pat. No. 5,297,817 describes a closet flange device for four inch diameter pipes that eliminates the need break the pipe at the joint. This device forms a compression seal by drawing two pieces together with nuts and bolts on the interior of the flange, forcing a rubber seal outward. The bolts of the prior invention remain inside the pipe, restricting flow through the closet flange and reducing its diameter.

The present invention is a substantial improvement on the prior art. The present invention uses a break-away method of applying the force needed to seal the invention to the existing pipe with a ratchet type mechanism preserving the force applied to the rubber seal. When the appropriate seal is achieved, the required hardware to apply the force is simply removed. Through the use of this superior mechanism, the present closet flange is capable of meeting standards for three inch pipes as well as four inch pipes, greatly increasing the use and versatility of the design. The present design is also suitable for use with schedule 40 P.V.C. and A.B.S. pipe.

It is therefore a principal object of this invention to provide an improved method and apparatus for replacing broken cast iron closet flanges in existing buildings.

It is another principal object of this invention to provide a cast iron closet flange replacement with telescoping ability to make it easier to repair a broken flange which is located below the floor level or above the floor level.

It is yet another principal object of this invention to provide a cast iron closet flange replacement that does not require removing the old leaded joint and pouring of new lead.

A further object of this invention is to provide a cast iron closet flange replacement that can be used with schedule 40 P.V.C. or A.B.S. pipe as well as cast iron pipe.

A still further object of this invention is to provide a cast iron closet flange replacement that is suitable for use with pipe having inside diameters as small as 3 inches.

Yet another object of the present invention is to provide a street compression closet flange which can be used in new building construction to eliminate the need to chisel away poured concrete from around the drain pipe before installing the flange.

SUMMARY OF THE INVENTION

The present invention is a three inch or larger street compression closet flange suitable for use in existing buildings to replace broken cast iron closet flanges or in new building construction in place of conventional closet flanges. The street compression closet flange comprises a flange body, a cup, a seal, and a means for applying pressure.

The flange body has a lower cylindrical portion, an upper cylindrical portion, a horizontal cap seat, a shoulder extending radially outward from one end of the upper cylindrical portion at a right angle, a series of sharp edged grippers extending radially from the lower cylindrical portion at the end furthest from the upper cylindrical portion, and a lip for seal above the grippers of the lower cylindrical portion for seating a substantially cylindrical seal. The upper cylindrical portion has a larger inside diameter than the outside diameter of the lower cylindrical portion. The horizontal cap seat connects both substantially cylindrical portions at a substantially right angle to each of them, leaving the substantially cylindrical portions concentric. This lip for seal forms a ledge at the upper end of the lower cylindrical portion suitable to support a means for applying pressure. The shoulder has a plurality of openings for receiving an attachment means.

The cup includes a substantially cylindrical portion, a shoulder, an angled lip suitable for seating a substantially cylindrical seal, and a series of reverse grippers. The reverse grippers have an inside diameter slightly smaller than the outside diameter of the exterior edge of the grippers on the lower cylindrical portion of the flange body, forming a ratchet type mechanism to maintain the relative position of the flange body to the cup.

The seal is substantially cylindrical and has an outside diameter slightly greater than the outside diameter of cup and an inside diameter that is slightly smaller than the outside diameter of the cup when the seal is in a non-expanded state. The seal is elastic so as to fit over the cup when the closet flange is assembled.

The means for applying pressure consists of a bolt, a cap, a break-away cap, and a nut. The cap is a substantially cylindrical disk containing a substantially cylindrical hole through its center. The bolt passes through this hole. The cap has an outer diameter that is slightly smaller than the inner diameter of the upper substantially cylindrical portion of the flange body, and substantially larger than the inner diameter of the lower substantially cylindrical portion of the flange body such that the cap rests on the horizontal cap seat. The hole through the cap has an outer diameter that is less than the outer diameter of the bolt head, allowing the bolt to exert pressure on the cap.

The bolt continues through the flange body, seal, and cup, and then passes through the a hole in substantially the center of the break-away cap, and finally through a nut. The outer dimensions of the nut are larger than the outer diameter of the substantially cylindrical hole, allowing the nut to exert pressure on the break-away cap. The break-away cap has outer dimensions that exceed the inner diameter of the cup. The cap is manufactured in such a way that it will break after a certain amount of pressure is exerted on to it, allowing the entire means for applying pressure to be removed from the ratchet type closet flange.

One preferred embodiment of the break-away cap is formed in the shape of a plus sign (+) with break-away arms extending radially outward from the center of the break-away cap at substantially right angles to each other. Break-away ledges extend radially outward from the break-away arms. The outer diameter of the break-away ledges is slightly larger than the inner diameter of the cup. The outer diameter of the break-away arms is slightly less than the inner diameter of the cup. When a certain amount of pressure is applied to the break-away cap, the break-away ledges breakaway from the break-away arms, leaving the break-away cap with a slightly smaller outer diameter than the inner diameter of the cup, and therefore allowing removal of the means for applying pressure from the ratchet type closet flange. Although the breakaway ledges fracture, they do not completely break off of the break-away cap, but rather remain affixed with a rigid structure, and thus are removed from the pipe when the means for applying pressure is removed from the ratchet type closet flange.

The ratchet type closet flange is assembled so that the cap is placed on the horizontal cap seat between the upper and lower cylindrical portions of the flange body, the seal is placed around the cup, the cup and the flange body are placed together, and the break-away cap is placed below the cup. The bolt is inserted through the substantially cylindrical holes of the cap and the break-away cap and the nut is attached to the bolt below the break-away cap. The invention is installed in place and the bolt tightened. Upon tightening, the cup is drawn up onto the flange body, causing the grippers on the lower cylindrical portion of the flange body to engage the reverse grippers on the cup, so that the cup mates with the flange body, locking the two together. The seal is forced outward, forming a compression fit between the seal and the inside of the drain pipe. When a suitable amount of pressure is applied to the means for applying pressure, the ledges of the break-away cap fracture, allowing the means for applying pressure to be drawn up through the center of the ratchet type closet flange and completely removed.

THE DRAWINGS

DETAILED DESCRIPTION OF THE INVENTION

Figure 1:
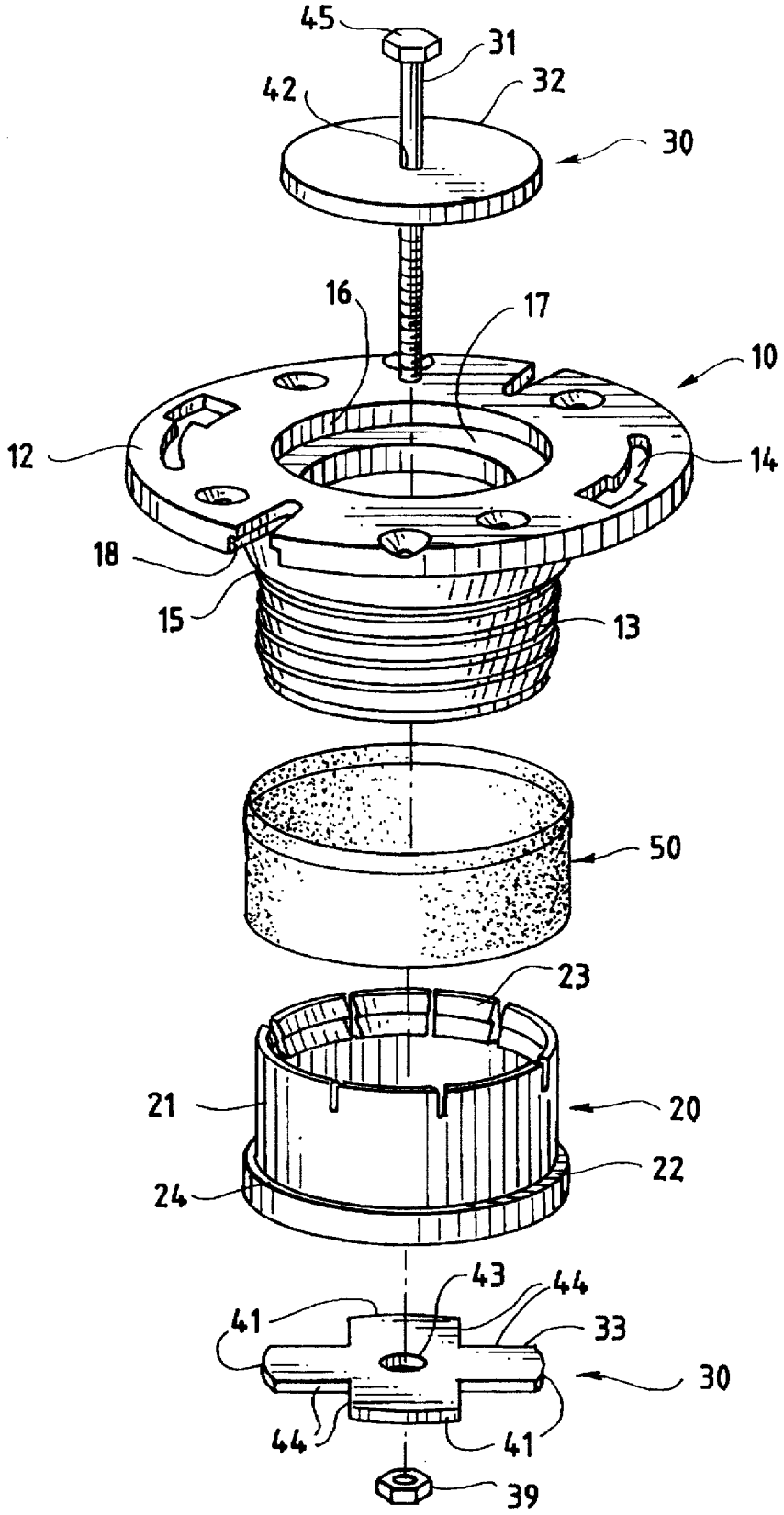
FIG. 1 is an exploded view of the preferred embodiment of the ratchet type street compression closet flange.

Turning to the drawings, FIGS. 1 to 5 show the preferred embodiment of the invention. As best shown by FIG. 1, the street compression closet flange consists of a flange body 10, a cup 20, a seal 50, and a means for applying pressure 30 for tightening the street compression closet flange after insertion into a pipe.

Figure 4:
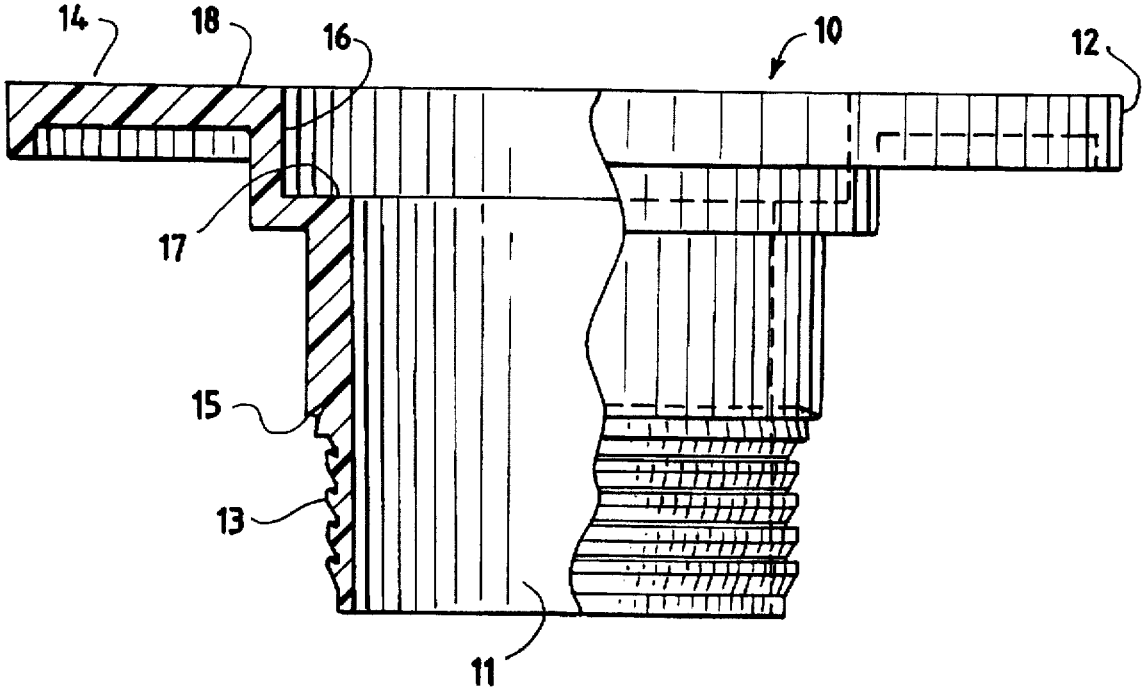
FIG. 4 is a cross-sectional break out view of the preferred embodiment of the flange body of FIG. 1.

An examination of FIG. 4 shows a flange body 10 consisting of a lower substantially cylindrical portion 11 attached to a horizontal cap seat 17 extending radially outward from the lower substantially cylindrical portion 11 at a substantially right angle. An upper substantially cylindrical portion 16 extends from the outer edge of the horizontal cap seat 17 at a substantially right angle. A shoulder 12 extends radially outward from the upper substantially cylindrical portion 16 and contains a plurality of openings 14 and slots 18 for accepting bolts or the like which are used to secure the flange body 10 to a toilet or other plumbing fixture. The lower exterior surface of the lower substantially cylindrical portion 11 contains grippers extending radially outward. Preferably, a lip for seal 15 extends radially outward from the lower substantially cylindrical portion at an angle substantially 60 degrees, forming a 30 degree groove from a horizontal reference line (not shown).

Figure 5:
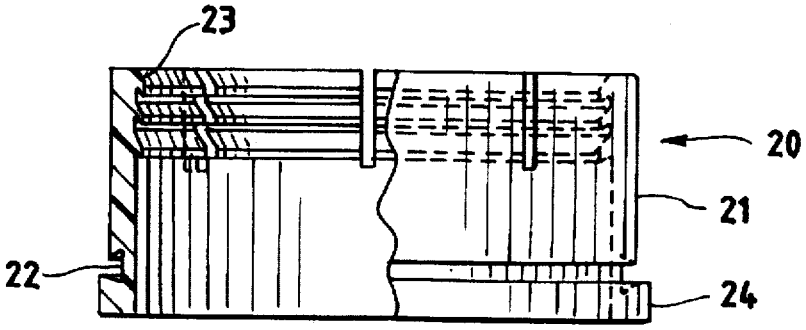
FIG. 5 is a cross-sectional break out view of the preferred embodiment of the cup of FIG. 1.

Turning to FIG. 5, a cup 20 is shown consisting of a substantially cylindrical portion 21 with reverse grippers 23 extending radially inward from one end of the substantially cylindrical portion 21. A shoulder 24 extends radially outward from the other end of the cylindrical portion at a substantially right angle. Preferably, the side of the shoulder 24 towards the reverse grippers contains an angled lip 22, forming a 30 degree groove from a horizontal reference line (not shown).

Figure 2:
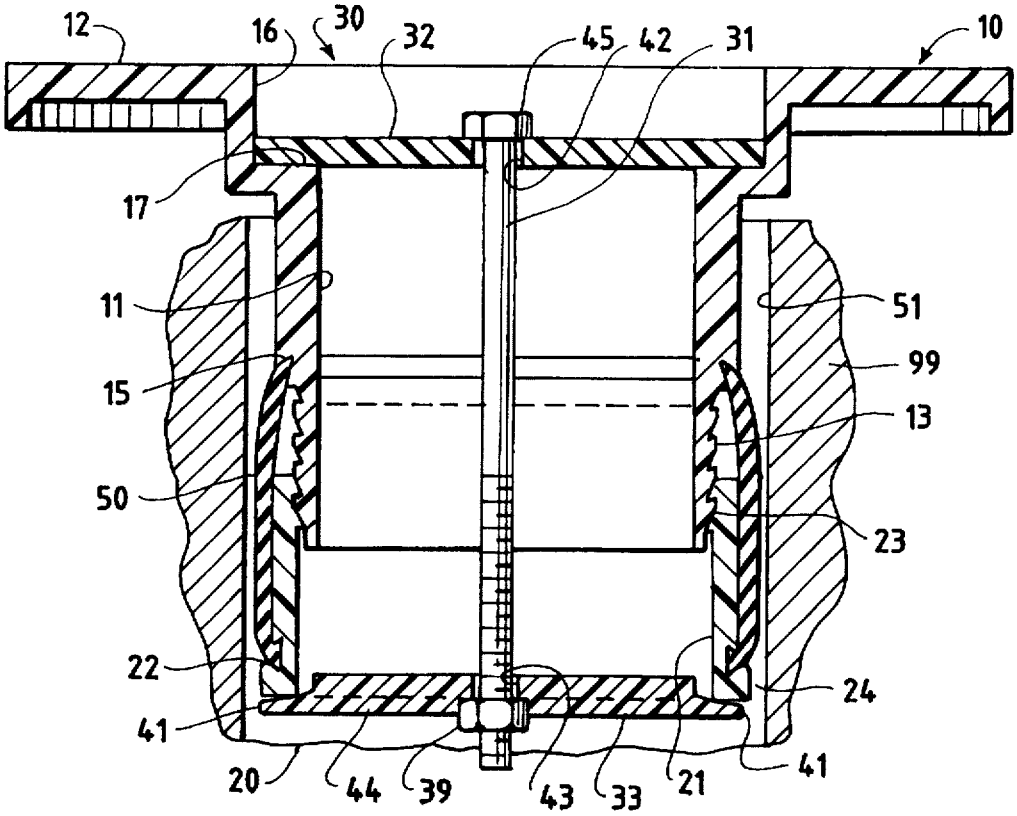
FIG. 2 is a cross-section view of flange of FIG. 1, shown assembled and before the break-away cap is broken.

As best shown in FIG. 2, the reverse grippers 23 have an interior diameter of sufficient size for receiving the grippers 13. That is, the internal diameter of the reverse grippers 23 is slightly larger than the outside diameter of the grippers 13, allowing the cup 20 to be pulled up around the flange body 10.

As FIG. 2 shows, when the invention is assembled, the seal 50 fits around the substantially cylindrical portion 21 of the cup 20 and the grippers 13. When the invention is first installed into a pipe, the means for applying pressure 30 is in place.

Figure 3:
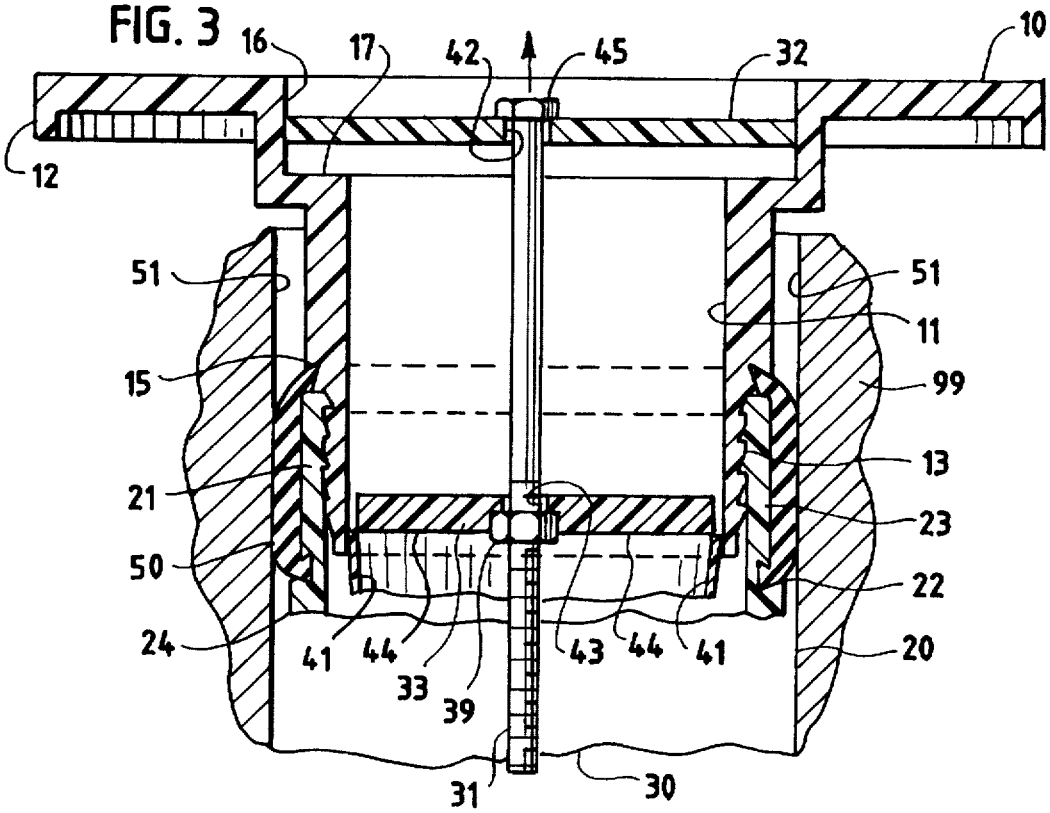
FIG. 3 is a cross-section view of the flange of FIG. 2, shown after the cap has broken away and released the pressure on the flange.

FIG. 3 shows the invention installed into a pipe immediately after the cap 33 has broken away, but before it has been drawn up and removed. The means for applying pressure 30 has pulled the cup 20 up around the grippers 13 of the flange body 10. The outside diameter of the seal 50 is slightly larger than the outside diameter of the substantially cylindrical portion 21 of the cup 20 when the seal 50 is not expanded. The inside diameter of the seal 50 is slightly smaller than the outside diameter of the substantially cylindrical portion 21 of the cup 20. As the cup 20 is drawn up around the flange body 10, the seal 50, wedged between the lip for seal 15 and the angled lip 22, is forced outward, forming a compression fit between the seal 50 and the inside of the pipe 99.

FIG. 1 best illustrates the means for applying pressure 30. The means for applying pressure 30 consists of a bolt 31 passing through the cap 32. The cap 32 may be a substantially cylindrical disk with an outside diameter less than the inside diameter of the shoulder 12, but greater than the inside diameter of the lower substantially cylindrical portion 11 of the flange body 10. Thus, the cap 32 rests upon the horizontal cap seat 17. The cap 32 contains a hole 42 passing through its center to allow passage for the bolt 31. The outer dimension of the hole 42 is less than the outer dimension of the bolt head 45, allowing the bolt to exert pressure on the cap.

The bolt then passes through the center bore of the flange body 10, the seal 50, and the cup 20. Next, the bolt passes through a hole 43 in the break-away cap 33. Finally, a nut 39 is attached to the bolt. The hole 43 has an outer dimension that is less than the outer dimension of the nut 39, allowing the nut to apply pressure to the break-away cap 33. The break-away cap 33 has outer dimensions that exceed the inner diameter of the cup 20.

As shown in FIG. 3, the break-away cap is manufactured in such away that it will break after a certain amount of pressure is applied, allowing the means for applying pressure 30 to be removed from the invention. In FIG. 1, one preferred embodiment of the invention shows a break-away cap 33 shaped like a plus sign (+), with arms 44 extending radially outward. The outer dimension of the arms 44 is slightly smaller than the inner dimension of the cup 20. A break-away ledge 41 extends beyond the outer diameter of each arm 44. The outer dimension of the break-away ledges 41 is slightly larger than the inner dimension of the inner dimension of the cup 20, allowing the break-away cap 33 to exert pressure on the cup 20. The break-away cap 33 is designed so that the break-away ledges 41 break after enough pressure is applied to form the desired compression fit between the seal 50 and the pipe 99.

FIG. 2 shows the invention inserted into the pipe before the means for applying pressure 30 is used. The means for applying pressure 30 pulls the cup 20 up around the flange body 10. As the bolt 31 is turned, the bolt 31 applies pressure on the cap 32 in a downward direction. Simultaneously, the nut 39 applies pressure on the break-away cap 33 in an upward direction. The cap 32 and break-away cap 33 apply pressure to the flange body 10 and the cup 20, respectively. This pressure causes the cup 20 to be drawn up around the flange body 10. The grippers 13 and the reverse grippers 23 engage each other, holding the flange body 10 and the cup 20 stationary with relationship to each other.

Turning to FIG. 3, the invention is shown after the means for applying pressure 30 has installed the ratchet type closet flange. The means for applying pressure has pulled the cup 20 up around the flange body 10. The joining of the flange body 10 and the cup 20 causes the seal 50 to be forced out away from those parts, forming a compression seal with the pipe 99. The break-away ledges 41 have broken from the arms 44 and the entire means for applying pressure, including the remains of breakaway ledges 41, are being removed from the closet flange, passing through the cup 20, the seal 50, and the flange body 10.

This invention is suitable for use in cast iron pipe, and unlike most other flanges, is also suitable for use in P.V.C. or A.B.S. pipe. This invention is recommended for pipe diameters of three inches or greater. Because the invention rests inside the pipe, it effectively reduces the pipe diameter. Use in pipes smaller than three inches restricts the available flow area to an unacceptable level.

The present invention is useful in replacing broken cast iron flanges in old buildings where the cost of replacing a broken flange with a convention flange, including the cost of cleaning out the old lead joints, is prohibitive and the process is dangerous. To replace a broken flange, a plumber first breaks or cuts off the old flange with a hammer or other tool, possibly down to the floor level. Due to the telescoping ability of the present invention, breaking the flange off too low usually is not a problem. Next, the parts of the invention are assembled in the order shown in FIG. 1, but the bolt is not tightened. The invention is placed into the old pipe with the shoulder 12 at the desired level to connect to a toilet or other plumbing device. The pipe and the flange are then sealed by tightening the bolt. After the flange is sealed in place, the breakaway cap fractures, allowing the means for applying pressure to be completely removed from the pipe and new flange.

The present invention is also useful in new construction with P.V.C. pipe or A.B.S. pipe. In new building construction, drains are typically installed first and concrete floors poured later. When a conventional flange is used, it is necessary to chip away the concrete from around the pipe to make room for the flange. The present invention eliminates the need to chip away the concrete around the pipe, thus making the task of installing the flange simpler, more cost efficient, and safer.

Of course, a person who is skilled in the art will recognize many other embodiments and modifications in light of the teachings of this patent. Therefore, the invention is not limited to the exact construction and operation described, but any suitable modification is included within the claims below.

I claim:

1. A ratchet type closet flange for installation inside one end of a pipe, the flange comprising:

a flange body having a substantially cylindrical portion with upstream and downstream ends, upwardly angularly disposed grippers extending radially outward from the cylindrical portion, and a seat for accommodating a seal located circumferentially about the upstream end of the cylindrical portion;

a substantially cylindrical cup having downwardly angularly disposed reverse grippers extending radially inward from the cup and configured to engage the flange body grippers in ratchet type fashion when the cup is drawn over the outside of the flange body, and a circumferentially disposed shoulder located at the cup downstream end;

a seal configured to fit around the cup and wedged between the flange body seat and the cup shoulder; and means for drawing the cup reverse grippers into engagement with the flange grippers causing the seal to bow outwardly and against the pipe to provide a compression fit between the flange and the pipe.

2. The flange of claim 1 wherein the means for drawing the cup reverse grippers into engagement with the flange reverse grippers comprises:

a first cap disposed against the flange body upstream end;

a second cap disposed against the cup downstream end; and a combination nut and bolt passing through the first and second caps whereby turning the bolt draws the first and second caps together until the second cap breaks away under a desired amount of pressure.

3. The ratchet type closet flange of claim 1 wherein the flange body further comprises a shoulder extending radially outward from the upstream end and having a plurality of openings and slots for accepting means to secure the flange body to a plumbing fixture.

4. The ratchet type closet flange of claim 1 wherein the seat for accommodating the seal is downwardly disposed at about a 60 degree angle from the horizontal.

5. The ratchet type closet flange of claim 1 wherein the shoulder of the cup extends radially at about a 90 degree angle and comprises an angled lip at about 30 degrees, suitable for anchoring the substantially cylindrical seal.

6. The ratchet type closet flange of claim 1 wherein the flange body and cup are molded from resilient plastic material from the group consisting of polyethylene, polypropylene, and nylon.

7. A method for replacing a broken cast iron closet flange comprising the steps of:

removing the broken cast iron closet flange;

inserting the ratchet type closet flange according to claim 1 by pushing it down inside the pipe;

sliding the ratchet type closet flange up or down to achieve the desired height;

forming a compression seal between the flange and the pipe by tightening the means for drawing the cup reverse grippers into engagement with the flange grippers; and removing the means for drawing the cup reverse grippers into engagement with the flange grippers from the ratchet type closet flange.

8. A ratchet type closet flange for installation on top of a drain pipe, the flange comprising:

a flange body having upstream and downstream ends, a lower substantially cylindrical portion, a horizontal cap seat extending radially outward from the upstream end of the lower substantially cylindrical portion at a substantially right angle, an upper substantially cylindrical portion extending from the outer edge of the horizontal cap seat at a substantially right angle, a shoulder extending radially outward from the upper substantially cylindrical portion and having a plurality of openings and slots for accepting means to secure the flange body to a plumbing fixture, grippers extending radially outward from the exterior surface of the lower substantially cylindrical portion, and an angled lip for anchoring a seal extending downwardly and radially outward from the lower cylindrical portion at a substantially 60 degree angle from the horizontal;

a cup having a substantially cylindrical portion, reverse grippers extending radially inward from the interior surface of the downstream end of the substantially cylindrical portion, a shoulder extending radially outward and having an angled lip extending upward at substantially 30 degrees from the horizontal and suitable for anchoring a substantially cylindrical seal;

a substantially cylindrical seal disposed around the circumference of the substantially cylindrical portion of the cup and anchored between said lips and having an inner diameter slightly smaller than the outside diameter of the substantially cylindrical portion of the cup and an outside diameter slightly larger than the outside diameter of the substantially cylindrical portion of the cup;

and means for drawing the cup up around the lower substantially cylindrical portion of the flange body, causing the grippers to engage in ratchet type fashion the reverse grippers, forcing the substantially cylindrical seal outward, thereby providing a compression fit between the cylindrical seal and the inside of said pipe.

* * * * *